US011410514B2

(12) United States Patent
Lamontagne et al.

(10) Patent No.: US 11,410,514 B2
(45) Date of Patent: Aug. 9, 2022

(54) ANTI-THEFT TRANSPONDER

(71) Applicant: The Swatch Group Research and Development Ltd, Marin (CH)

(72) Inventors: Alexandre Lamontagne, Cormondreche (CH); Jonathan Bregnard, St-Aubin-Sauges (CH); Cedric Nicolas, Neuchatel (CH); Cedric Kaltenrieder, Courtelary (CH); Paulo Bravo, Marin-Epagnier (CH)

(73) Assignee: The Swatch Group Research and Development Ltd, Marin (CH)

( * ) Notice: Subject to any disclaimer, the term of this patent is extended or adjusted under 35 U.S.C. 154(b) by 18 days.

(21) Appl. No.: 16/912,987

(22) Filed: Jun. 26, 2020

(65) Prior Publication Data

US 2021/0065526 A1 Mar. 4, 2021

(30) Foreign Application Priority Data

Aug. 26, 2019 (EP) ..... 19193623

(51) Int. Cl.
*G08B 13/24* (2006.01)

(52) U.S. Cl.
CPC ..... *G08B 13/2434* (2013.01); *G08B 13/2482* (2013.01)

(58) Field of Classification Search
CPC ..... A61F 13/42; E05B 17/22; E05B 73/0017; E05B 73/0035; E05B 2047/058;
(Continued)

(56) References Cited

U.S. PATENT DOCUMENTS 1,470,115 A * 10/1923 Glaudel ..... B60J 1/14 403/384
5,146,206 A * 9/1992 Callaway ..... A61B 5/1116 200/DIG. 2

(Continued)

FOREIGN PATENT DOCUMENTS

CN 1507525 A 6/2004
CN 2934501 Y 8/2007

(Continued)

OTHER PUBLICATIONS

European Search Report dated Feb. 27, 2020 in European Application 19193623.6 filed Aug. 26, 2019 (with English Translation of Categories of Cited Documents), 4 pages.

(Continued)

*Primary Examiner* — Stephen R Burgdorf
(74) *Attorney, Agent, or Firm* — Oblon, McClelland, Maier & Neustadt, L.L.P.

(57) ABSTRACT

A transponder for securing a product displayed in a shop. The transponder includes two blocks each including a contact surface, the contact surfaces being positioned face to face, the blocks being connected to each other by an adjustable connection, that allows to manually adjust the moving closer together or farther apart of the blocks with respect to one another, thus allowing the transponder to be attached to a suitable element of the product, by gripping the element between the contact surfaces of the blocks, one of the blocks including wireless detection and transmission equipment, which allows the remote management of the presence of the transponder on the suitable element.

5 Claims, 2 Drawing Sheets

(58) Field of Classification Search
CPC ..... G06K 7/10039; G06K 19/027; G07C 9/00944; G08B 13/1418; G08B 13/2402; G08B 13/2428; G08B 13/2482; H01H 27/002; H02J 30/12; H04N 1/00812
USPC ..... 340/568.2
See application file for complete search history.

(56) References Cited

U.S. PATENT DOCUMENTS

2007/0283729 A1* 12/2007 Saitoh ..... E05B 73/0017 70/57.1
2008/0061987 A1 3/2008 Kolton et al.
2009/0188082 A1* 7/2009 Huang ..... E05D 5/12 16/382
2010/0126238 A1* 5/2010 Mazzucchelli ..... E05B 73/0035 70/58
2010/0176951 A1* 7/2010 Zinner ..... E05B 73/0035 340/572.9
2015/0048946 A1* 2/2015 Luo ..... G08B 13/2434 340/572.8
2016/0364968 A1 12/2016 Sharpy et al.
2020/0285921 A1* 9/2020 Chandramowle ..... G06K 19/07758

FOREIGN PATENT DOCUMENTS

CN 204166638 U 2/2015
CN 107924600 A 4/2018
CN 208280770 U 12/2018
WO WO 96/14488 * 11/1995 ..... E05B 73/00
WO WO 96/14488 A1 5/1996
WO WO 2016/201205 A1 12/2016

OTHER PUBLICATIONS

Combined Chinese Office Action and Search Report dated Nov. 23, 2021 in Chinese Patent Application No. 202010855781.8 (with English translation of Category of Cited Documents), 9 pages.

* cited by examiner

ANTI-THEFT TRANSPONDER

CROSS-REFERENCE TO RELATED APPLICATION

This application claims priority to European Patent Application No. 19193623.6 filed on Aug. 26, 2019, the entire disclosure of which is hereby incorporated herein by reference.

TECHNICAL FIELD OF THE INVENTION

The present invention relates to security systems usable in shops for luxury products, such as glasses or watches.

PRIOR ART

To protect the products displayed in a shop, systems, that use RFID (Radio Frequency Identification) chips attached to the products are known. These systems require the use of a bulky mechanical fastening of the chip, to be removed at the till upon purchase using a special device or a pair of scissors, as well as the installation of bulky infrastructure, in particular scanners installed at the shop exit.

Anti-theft systems of the wired type, which prevent a product installed on a display stand from being moved away from said display stand, by using a wire between the product and the display stand, are also known. These systems are also capable of managing the presence of the products on the display stands. But these systems are bulky and often they prevent the customer from trying the product.

SUMMARY OF THE INVENTION

The present invention aims to provide a transponder, which can be connected to a product and which allows to secure the product without the disadvantages described above.

This goal is achieved by the transponder according to the attached claims. The transponder according to the invention comprises two blocks each comprising a contact surface, the contact surfaces being positioned face to face, the blocks being connected to each other by an adjustable connection, which allows to manually adjust the moving closer together or farther apart of the blocks with respect to one another, thus allowing the transponder to be attached to a suitable, for example elongated, element of said product, by gripping the element between the contact surfaces of the blocks, one of the blocks comprising wireless detection and transmission equipment, which allows the remote management of the presence of the transponder on the elongated element.

The transponder according to the invention is easy to remove at the till. The monitoring by wireless and local communication, such as by BLE communication, allows to monitor the presence of the products in the shop without requiring scanners at the exit. The customers are capable of manipulating the products in the shop, without obstruction by wired securing.

Other features and advantages of the present invention will appear in the following description of preferred embodiments, presented as a non-limiting example in reference to the appended drawings.

DETAILED DESCRIPTION OF THE INVENTION

Figure 1:
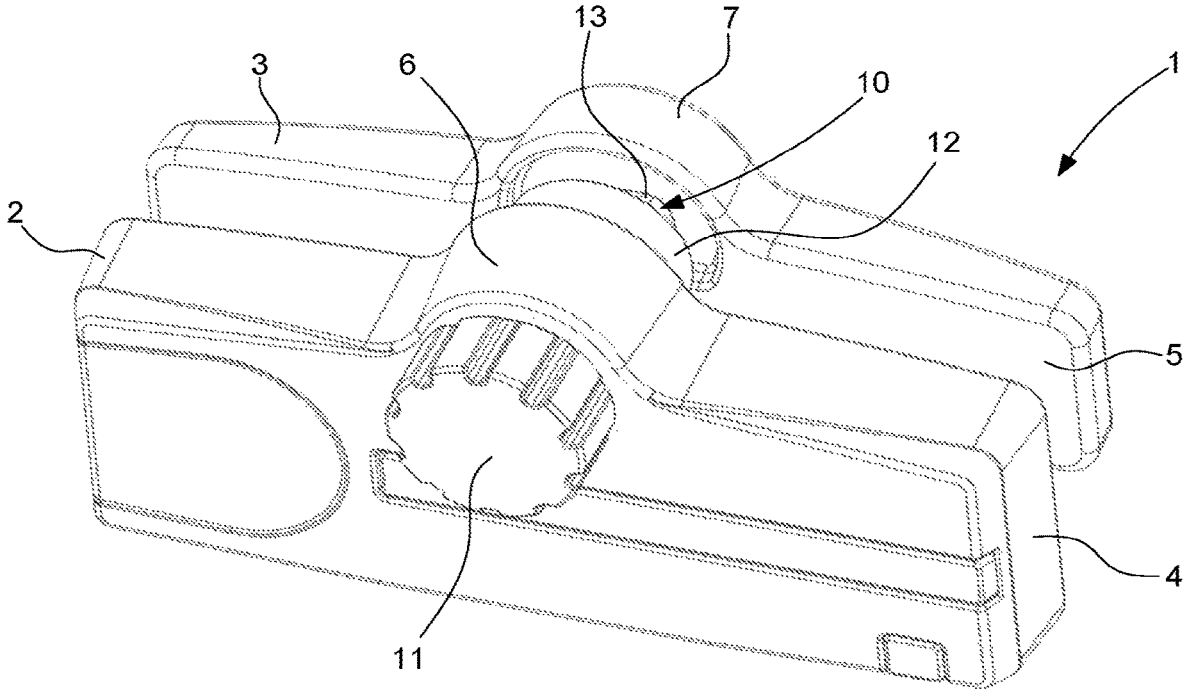
FIG. 1 shows a transponder according to a preferred embodiment of the invention.

FIG. 1 shows a transponder 1, hereinafter called "tag", according to the invention. The tag 1 comprises two blocks 2 and 3 having a substantially rectangular shape. Two lateral and flat surfaces 4 and 5 of the respective blocks are mounted face to face and substantially parallel with respect to one another. The blocks 2 and 3 are provided with respective protrusions 6 and 7 in the middle of their upper faces above the contact surfaces 4, 5, said protrusions being connected to each other by an adjustable connection. In the embodiment illustrated, this is a screw connection 10. The rotation of a washer 11 rotates a threaded sleeve 12, in such a way as to actuate the axial movement of the sleeve 12 with respect to a threaded hole provided in the first block 2, when the washer 11 is rotated. A rod 13 connects the sleeve 12 to the second block 3. The rotation by hand of the washer 11 actuates the movement closer together or the separation of the blocks 2 and 3. This allows to fasten the tag 1 onto a suitable, for example elongated, element such as a rounded or flat rod, by gripping the elongated element between the contact surfaces 4 and 5 of the blocks 2 and 3 and by tightening the washer 11.

Figure 2:
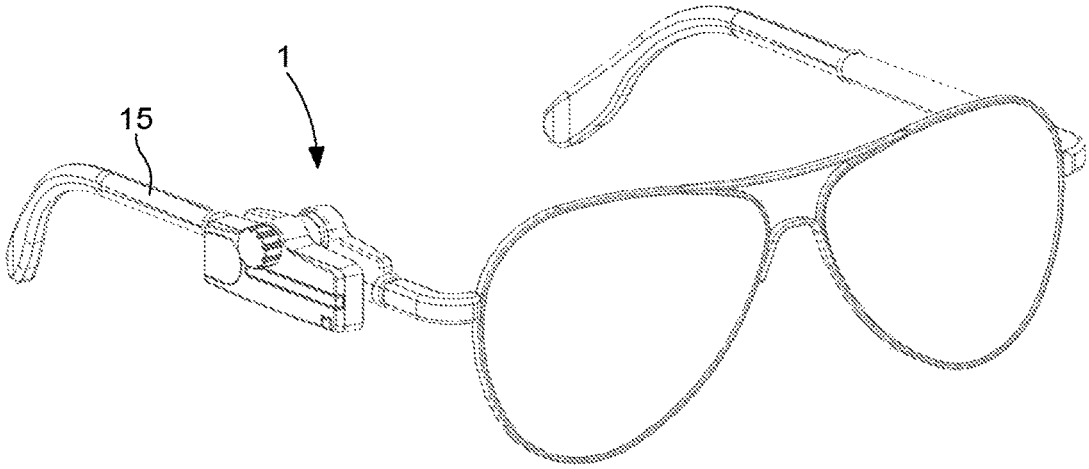
FIG. 2 shows the transponder of FIG. 1, attached to a temple of a pair of glasses.

The attachment of the tag 1 to a temple 15 of a pair of glasses is illustrated in FIG. 2. Preferably, the contact surfaces 4 and 5 of the blocks 2 and 3, i.e. the surfaces, that come in contact with the temple 15, are provided with a layer made of a resilient flexible material, which allows to fasten the tag 1 by tightening the washer 11 until the resilient material is compressed, without degrading the appearance of the product to be protected. In the case of temples or rods having a round cross-section narrower than the blocks, the resilient layers will grasp around the temples when the washer 11 is tightened, in such a way as to carry out a high-resistance fastening.

The first block 2 further comprises detection and transmission equipment, which allows to manage the presence of the tag 1 on the secured product. In general, the detection and transmission equipment comprises a source of energy, for example a battery, a detection circuit and a circuit for transmission of a signal by a wireless connection. Preferably, the battery is a wirelessly rechargeable battery. The detection circuit includes at least one electrical switch actuatable into one or the other of two states, called "connected" or "disconnected". The switch is configured such that it is in one of the two states when the tag is attached to the product. Moreover, the switch automatically changes to the other state when the tag is removed from the product. The transmission circuit can be an electronic chip for wireless communication, such as a BLE (Bluetooth Low Energy) chip. The transmission circuit is connected to the detection circuit and configured to emit a signal, that is related to the state of the switch.

Figure 3:
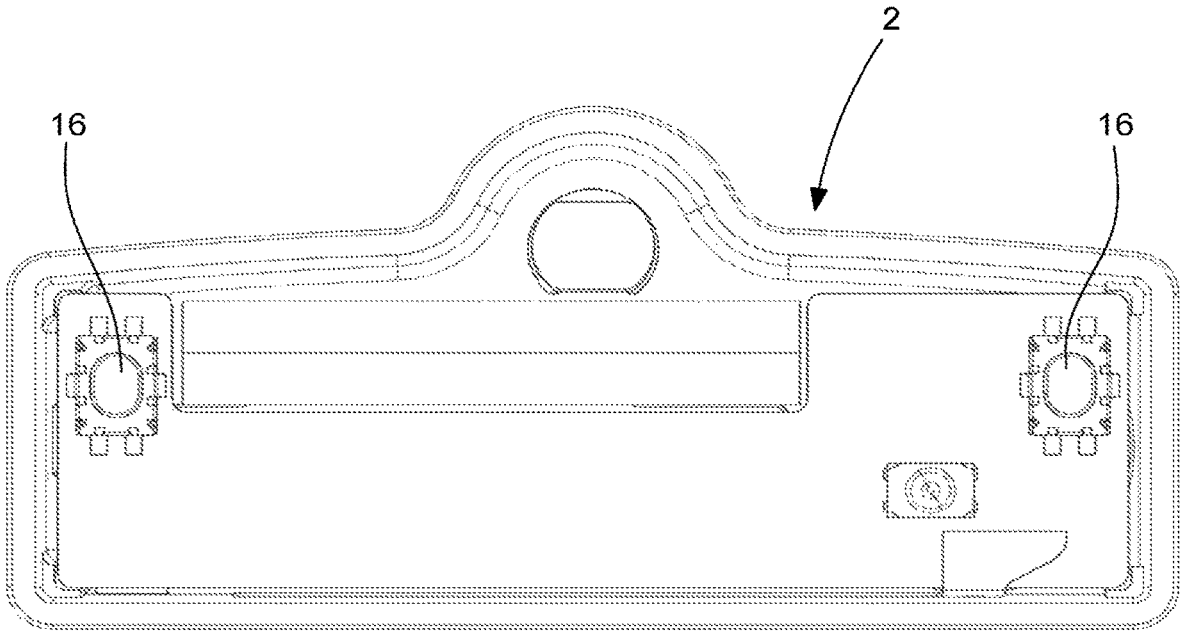
FIG. 3 shows a view of the electronic components in the transponder of FIG. 1.

In the embodiment illustrated in the drawings, the block 2, which comprises the detection and transmission equipment, is provided for example with two push buttons 16, positioned at the longitudinal ends of the contact surface 4 of the block 2. The buttons 16 are visible on the front view of the block 2, in FIG. 3. When the tag 1 is not attached to a product, the buttons 16 protrude from the plane of the contact surface. When the tag is installed on a rod or temple of a product, and when the screw connection 10 is tightened, the contact surface 5 of the other block 3 comes in contact with the buttons 16 towards the end of the moving closer together of the contact surfaces. This pushes the two buttons 16 by the fastening force of the tag when the screw connection 10 is tightened. The buttons 16 are connected to two respective switches (not shown) in such a way that the pushing or the release of the buttons 16 actuates one or the other of the "connected" or "disconnected" states of the switches. The buttons 16 are provided with a spring or equivalent mechanism, which releases the buttons automatically when the fastening force is removed, i.e. when the tag is removed from the product. The detection circuit can thus take on a plurality of forms according to the embodiment of the switches and of their connection. For example, the two switches can be coupled in series, forming part of a simple circuit powered by the battery of the detection and transmission equipment, so that the disconnection of at least one switch, i.e. the release of at least one push button, cuts off the power supply or generates an interruption. This interruption is detected by the detection circuit and translates into a specific signal by the transmission circuit. Other more complex configurations are possible for a person skilled in the art without going beyond the scope of the appended claims.

The securing of the product by a tag according to the invention is based on the wireless communication between the transmission circuit inside the tag and a receiver device at a distance from the tag but inside the shop in which the product is displayed. For example, a BLE chip is capable of sending a signal, that can be received by one or more receiver devices such as mobile telephones or tablets located in a configurable perimeter defined around the tag. BLE technology allows the continuous sending from the chip of a sequence of data called announcement or advertising frame. Consecutive frames can be encoded using an identifier, that identifies the secured product by a code, and which corresponds to the state of the buttons, and thus of the switches. The continuous sending of these advertising frames allows the persons responsible to continuously manage the presence of the tags on a certain number of products. When a tag is removed by an unauthorised person, this change is immediately represented in the advertising frames and signalled on the mobile telephones or tablets in the form of an audible alert signal for example. The mobile telephones are provided with a digital application, that manages the communication with the tags, and which indicates to the user an identifier of the product from which the tag has been removed, so that the user can go check the product.

The transponder according to the invention is easy to remove at the till. It suffices to extract the screw connection, and to ensure, that the person responsible who removes the tag can record via their mobile telephone or tablet, that this is an authorised removal. The monitoring by wireless and local communication, such as by BLE communication, allows to monitor the presence of the products in the shop without requiring scanners at the exit. The customers are capable of manipulating and trying the products in the shop, without obstruction by wired securing.

What is claimed is:

1. A transponder for securing a product displayed in a shop, the transponder comprising:

two blocks each comprising a contact surface that is flat and extends laterally across the block, the contact surfaces being positioned face to face and substantially parallel with respect to one another and configured to be moved toward or away from one another, the blocks being provided with protrusions that, when the contact surfaces are positioned vertically, are positioned on upper surfaces of the blocks above the contact surfaces, and wherein an adjustable connection connects said protrusions, which allows to manually adjust the moving closer together or farther apart of the blocks with respect to one another, thus allowing the transponder to be attached to a suitable element of said product, by gripping the element between the contact surfaces of the blocks, one of the blocks comprising wireless detection and transmission equipment, which allows the remote management of the presence of the transponder on the suitable element, wherein the detection and transmission equipment comprises a source of energy, an electrical detection circuit and an electrical transmission circuit, the detection circuit comprising at least one switch actuatable into one or the other of two states, the state of the switch being determined according to the attachment of the transponder to the suitable element, the switch being integrated into the detection circuit so that the state of the switch is detectable by the detection circuit, the transmission circuit being connected to the detection circuit so that the transmission circuit can emit a signal related to the state of the switch(es), wherein the contact surface of the block, that comprises the detection equipment comprises at least one push button configured to be:

pushed by a pressure exerted by the contact surface of the other block when the transponder is attached to the suitable element, and automatically released when the transponder is removed from the suitable element, and wherein the button is connected to a switch, in such a way that the state of the switch changes according to the pushed or released state of the button, wherein the detection equipment comprises two push buttons disposed and positioned at the longitudinal ends of a contact surface of the block, and wherein the two push buttons are connected to switches coupled in series, forming part of a circuit powered by a battery of the detection and transmission equipment, so that the disconnection of at least one switch, by the release of at least one push button, cuts off the power supply or generates an interruption, wherein the transmission circuit is an electronic chip configured to transmit a signal that is only receivable in a configurable local perimeter defined around the chip, and wherein the adjustable connection that connects said protrusions includes a washer extending out of a rear side of a first block of the two blocks and a threaded sleeve extending out of a front side of the first block, and a rod connects the threaded sleeve to a second block of the two blocks such that rotation of the washer in a first direction actuates axial movement of the threaded sleeve to move the first block and the second block closer together.

2. The transponder according to claim 1, wherein the contact surfaces have a substantially rectangular shape and are configured to be positioned in such a way that the longitudinal direction of the surfaces is parallel to the longitudinal direction of the suitable element.

3. The transponder according to claim 1, wherein the adjustable connection is a screw connection.

4. The transponder according to claim 1, wherein the contact surfaces are provided with a layer made of resilient and compressible material.

5. The transponder according to claim 1, wherein the source of energy is a battery.

* * * * *